US008393131B2

(12) United States Patent
Blunschi

(10) Patent No.: US 8,393,131 B2
(45) Date of Patent: Mar. 12, 2013

(54) DEVICE FOR THE ASSEMBLY OF POCKET SPRING STRINGS

(75) Inventor: David Blunschi, Wiezikon bei Sirnach (CH)

(73) Assignee: Spuhl AG, Wittenbach (CH)

( * ) Notice: Subject to any disclaimer, the term of this patent is extended or adjusted under 35 U.S.C. 154(b) by 243 days.

(21) Appl. No.: 12/918,570

(22) PCT Filed: Feb. 11, 2009

(86) PCT No.: PCT/CH2009/000058

§ 371 (c)(1),
(2), (4) Date: Aug. 20, 2010

(87) PCT Pub. No.: WO2009/103173

PCT Pub. Date: Aug. 27, 2009

(65) Prior Publication Data

US 2010/0326012 A1 Dec. 30, 2010

(30) Foreign Application Priority Data

Feb. 22, 2008 (CH) ..... 259/08

(51) Int. Cl.
*B68G 9/00* (2006.01)

(52) U.S. Cl. ..... 53/114; 156/556; 156/558; 5/716

(58) Field of Classification Search ..... 53/114; 156/538–539, 567, 578; 5/246, 254–257, 5/716, 655.7; 29/91, 91.1
See application file for complete search history.

(56) References Cited

U.S. PATENT DOCUMENTS

| | | | | |
|---|---|---|---|---|
| 5,746,877 | A * | 5/1998 | Notheis et al. | 156/356 |
| 5,885,407 | A * | 3/1999 | Mossbeck | 156/558 |
| 6,159,319 | A * | 12/2000 | Mossbeck | 156/182 |
| 6,175,997 | B1 * | 1/2001 | Mossbeck | 29/91 |
| 6,347,423 | B1 * | 2/2002 | Stumpf | 5/720 |

FOREIGN PATENT DOCUMENTS

| | | |
|---|---|---|
| DE | 4303089 | 8/1994 |
| JP | 200160604 | 3/2001 |
| WO | WO9810933 | 3/1998 |

* cited by examiner

*Primary Examiner* — M. Alexandra Elve
*Assistant Examiner* — Andrew M Tecco
(74) *Attorney, Agent, or Firm* — Wood, Herron & Evans, LLP

(57) ABSTRACT

The device for the assembly of pocket spring strings includes a rack, on which a drum having receptacles for pocket spring strings is rotatably supported. An operator manually places the pocket spring strings into the receptacles and rotates, or initiates the rotation of, the drum about a predetermined angle, for example 60°. Now, the operator places a further pocket spring string into the subsequent receptacle, and at the same time an adhesive is applied to the advanced pocket spring string. Following a further rotational movement of the drum, the next pocket spring string is inserted, an adhesive is applied to the previously inserted pocket spring string, and at the same time the pocket spring string to which the adhesive was applied and which is now located in front of the assembly device is ejected.

10 Claims, 2 Drawing Sheets

DEVICE FOR THE ASSEMBLY OF POCKET SPRING STRINGS

This application claims the benefit of International Application No. PCT/CH09/00058, filed on Feb. 11, 2009, which claims priority to Swiss Application No. CH 2008 0000259, filed on Feb. 22, 2008.

TECHNICAL FIELD

The subject of the invention is a device for the assembly of pocket spring strings.

BACKGROUND

Pocket springs arranged in the form of a string are formed into a spring core by placing strings side by side in parallel and connecting them. The connection of the pocket spring strings lying side by side is effected by an adhesive which has been applied laterally to the pocket spring string before they are joined together.

From EP 0421496 B1, for example, it is known either to apply an adhesive from above when drawing in a spring string, the spring axes of which are situated horizontally, or to apply the adhesive when the spring string has already been drawn in by moving the adhesive dispenser over the spring string. After that, the spring string is tilted by 90° and pressed against the preceding spring strings already adhesively bonded together and standing in the device. Such a device is suitable for fully automatic operation; a simple design and thus inexpensive production is not possible.

An object of the present invention now consists in providing a device for the assembly of pocket spring strings which can be operated semi-automatically or fully automatically.

SUMMARY OF THE INVENTION

This object is achieved by a device according to the features described below. Advantageous configurations of the invention are defined in the following description as well.

The device according to the invention succeeds in realizing a semi-automatic assembly of pocket spring strings to form spring cores in a simple and inexpensive manner. With the drum which precedes the spring receptacle for the wholly or partially joined-together mattress, it is possible to maintain fault-free assembly operation and the operator does not require any previous technical training at all. This machine can be automated subsequently with little additional expenditure.

BRIEF DESCRIPTION OF THE DRAWINGS

The invention is explained in more detail with the aid of an illustrated exemplary embodiment, in which.

DETAILED DESCRIPTION

Figure 1:
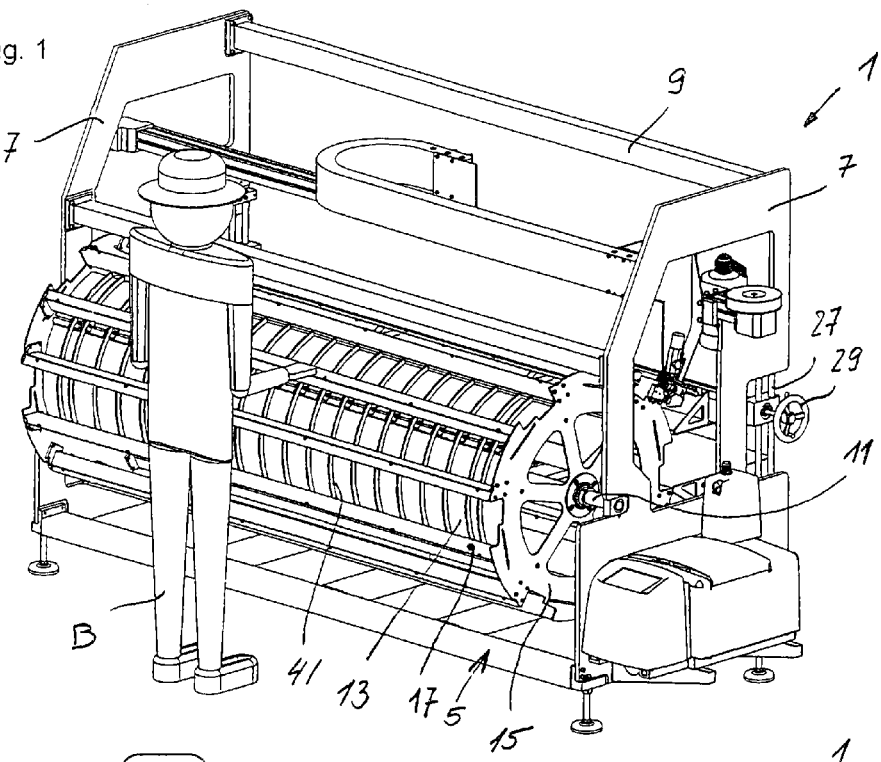
FIG. 1 shows a perspective illustration of a semi-automatic device with manual loading for the assembly of pocket spring strings.

Reference symbol 1 denotes a device for the assembly of pocket spring strings 3 to form a spring core for an interior spring mattress. The device 1 comprises a frame 5 with two side walls 7 connected to one another by horizontally running struts 9. On a shaft 11 fastened to the side walls 7 there is rotatably mounted a drum 13. The latter comprises at its end faces two discs 15, between which there are mounted, with mutual spacing, supports 17 fastened parallel adjacent to one another on the periphery of the discs 15. The spacings between the supports 17 can be set by parallel displacement of at least respectively one support 17 relative to the adjacent support 17. The device for displacing and fixing the supports 17 on the discs 15 is not described and illustrated in further detail.

Each two supports 17 lying adjacent to one another form between them a receptacle 19 for one pocket spring string 3 each. The spacing h between the supports 17 is dimensioned in such a manner that when the pocket spring strings 3 are inserted into the receptacle 19 they are slightly compressed and thus frictionally held by the supports 17.

Behind the drum 13 there is arranged an assembly device 25 for receiving the pocket spring strings 3. The pocket spring strings 3 are joined together and held on the assembly device 25 with their axes situated vertically.

Arranged above the drum 13 there is, furthermore, an application device 21, extending between the two side walls 7, for applying an adhesive to the pocket spring strings 3. An application head 23 with one or more application nozzles is fitted on the application device 21 so as to be movable parallel to the axis 11 of the drum 13.

The assembly device 25 can be vertically adjusted along vertically situated guides 27 by means of a handwheel 29 or a corresponding electric drive and adapted to the height of the pocket spring strings 3 which are being processed.

Arranged inside the drum 13 or so as to engage therein is a push-in element 31, by which that pocket spring string 3 which is situated at the height of the table 25 can be pushed out of the receptacle 19 or drawn towards the assembly device and pressed against the last pocket spring string 3 standing on the assembly device 25.

In the text which follows, the mode of operation of the semi-automatic device 1 for the assembly of pocket spring strings 3 is explained. An operator B removes put-together pocket spring strings 3 from a magazine (not illustrated in the figures) and inserts them at location a into the receptacle 19 situated there. During this, the springs are slightly compressed axially in the string, since the supports 17 forming the receptacle 19 have a smaller spacing than the height of the springs. Now, the operator B manually rotates the drum 13 until the inserted pocket spring string 3 is situated in position b. This rotational movement may of course also be effected by a foot pedal or a drive motor. An empty receptacle 19 is now located in front of the operator B again, at position a, and the operator inserts the next pocket spring string 3 into this receptacle. Simultaneously, an adhesive, e.g. a hot melt or the like, is applied to the pocket spring string 3 previously led from position a to position b by the application device 21 or the application head 23 moving axially above the pocket spring string 3.

Following insertion of the pocket spring string 3 into the receptacle 19 and simultaneous application of an adhesive to the preceding pocket spring string 3, a rotational movement of the drum 13 is effected once again. Following this rotational movement, the pocket spring string 3 inserted first is situated in position c and the axes of the springs in the pocket spring string 3 are now vertical, so that it can be pushed by the push-in element 31 out of the receptacle 19 onto the assembly device 25 and pressed there against the rearmost spring string 3 and adhesively bonded thereto. In this period of time, the operator B once again inserts a pocket spring string 3 into the receptacle 19 at position a. Simultaneously, an adhesive is applied to the previously inserted pocket spring string 3 by the application device 21, and so on.

Thus, three actions always take place simultaneously, namely (a) insertion of a pocket spring string 3 into the receptacle 19, (b) application of an adhesive to the pocket spring string 3 and (c) transfer of the pocket spring string 3 to which an adhesive has been applied into the assembly device 25 and simultaneous pressing against the preceding pocket spring string 3.

In a further development of the invention, the operator B can be replaced by an automatic feed. For this purpose, two conveyor belts 33 are arranged one above the other in front of the drum 13, the mutually facing strands 35 of which belts are at a mutual spacing which is somewhat less than the height of the pocket spring string 3 to be processed. The pocket spring strings 3 are led laterally up to the conveyor belts 33 by a coiling and pocketing device (not illustrated and described) known from the prior art and can be introduced between the two carrying strands 35 by means of an indexing wheel 39. The two strands 35 can be guided preferably so as not to run completely parallel in the introduction region, but their spacing is somewhat greater in the region of the indexing rollers 39, so that the pocket spring strings 3 are slightly axially compressed successively as they are drawn in between the two conveyor belts 33 (conicity of the conveyor belts 33 not illustrated). As soon as a pocket spring string 3 is located directly in front of the drum 13, the drive of the conveyor belts 3 is interrupted and the pocket spring string 3 is pushed into the receptacle 19 on the drum 13 by an advancing element 37 in the form of a beam. The pushing-in and insertion of the pocket spring strings 3 into the receptacles 19 of the drum 13 are in this case effected not immediately adjacent to the top S of the drum 13 (position a), but at the point when the receptacle 19 is located at the front of the drum 13 (position d).

Figure 2:
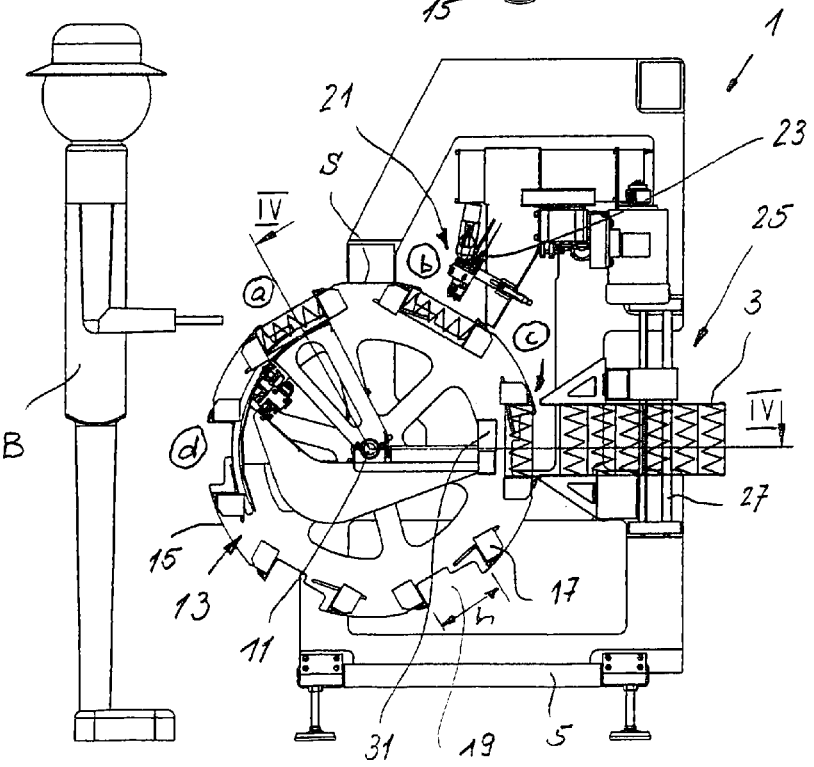
FIG. 2 shows a vertical section through the device according to FIG. 1.
Figure 3:
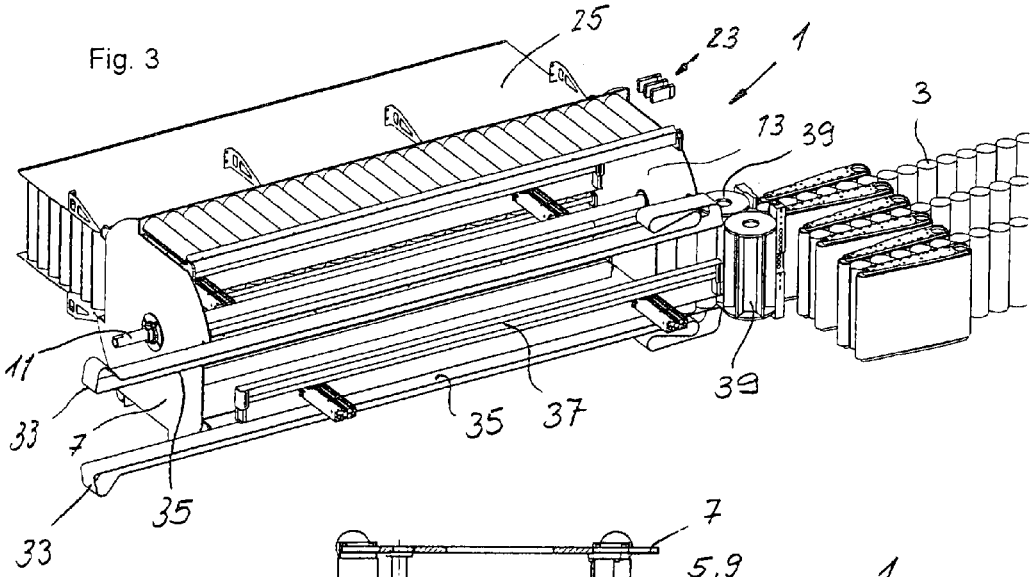
FIG. 3 shows a perspective view of the loading drum of the assembly table and of an automatic feed of the spring strings and FIG. 4 shows a section through the device along the line IV-IV in FIG. 2.

The application of an adhesive can be effected behind the top S of the drum 13, as in the manually loaded device 1 according to FIGS. 1 and 2, or, as illustrated in FIG. 3, when the receptacle 19 is located at the top and the axes of the springs in the pockets are oriented horizontally there. Both the application of an adhesive and the subsequent pushing of the pocket spring strings 3 out of the receptacles 19 of the drum 13 are effected as in the manually loaded device.

Webs 41 are arranged, at axial spacings in the loading region (d to a), on a strip fastened to the shaft 11. The spacings correspond to the spacings of the axes of the springs in the spring strings 3. In order to be able to process spring strings 3 having springs with greater or smaller diameters, the webs 41 can be displaced in the axial direction on the drum. The displacement and repositioning of the webs 41 again can be effected manually or with a suitable drive (not illustrated).

Figure 4:
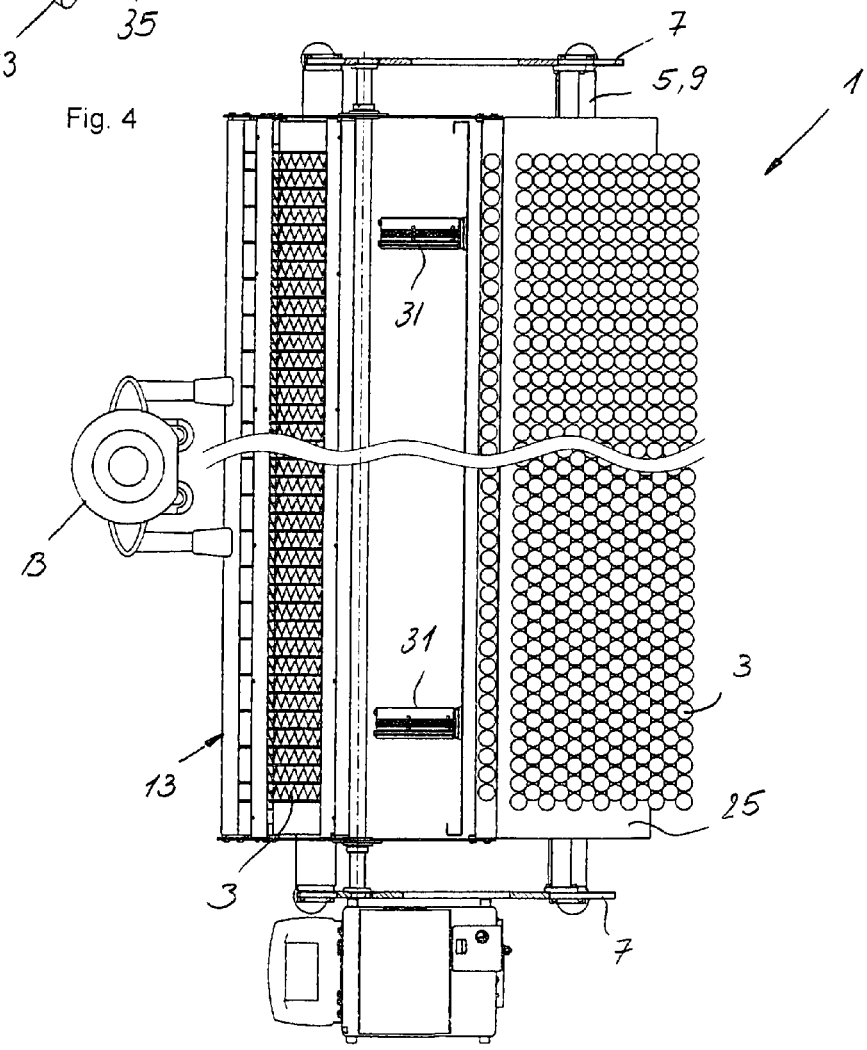

If desired, the webs 41 can be displaced axially by half a web spacing. This makes it possible to arrange the springs in the pocket spring strings 3 either in a so-called parallel assembly (cf. FIG. 4, top half of the figure) or in a so-called staggered assembly (cf. FIG. 4, bottom half of the figure). If the pocket spring strings 3 are arranged in a parallel assembly, the springs situated therein always lie in a line, when seen each in a horizontal and vertical direction. In the case of a staggered assembly, the springs form a zigzag line when seen in a horizontal direction. The displacement of the strips with the webs 41 mounted thereon can be effected at the push of a button by a drive, or manually by the operator B.

The invention claimed is:

1. A device for the assembly of pocket spring strings to form a spring core for mattresses, comprising:

receptacles for pocket spring strings formed of pocket springs, a transfer mechanism for transferring individually fed pocket spring strings from an insertion position (a) to a transfer position (c), and a pushing-in element for transferring the pocket spring strings from the transfer mechanism to an assembly device, wherein the transfer mechanism comprises a rotatably mounted drum, at the periphery of which are formed groove-shaped receptacles into which the pocket spring strings can be inserted and transferred from the insertion position (a) to an adhesive-bonding station (b), above which is arranged an application device for applying an adhesive, and wherein the width of the receptacles can be set and adjusted to the height of the springs to be processed by parallel displacement of the supports forming the receptacles.

2. A device for the assembly of pocket spring strings to form a spring core for mattresses, comprising:

receptacles for pocket spring strings formed of pocket springs, a transfer mechanism for transferring individually fed pocket spring strings from an insertion position (a) to a transfer position (c), and a pushing-in element for transferring the pocket spring strings from the transfer mechanism to an assembly device, wherein the transfer mechanism comprises a rotatably mounted drum, at the periphery of which are formed groove-shaped receptacles into which the pocket spring strings can be inserted and transferred from the insertion position (a) to an adhesive-bonding station (b), above which is arranged an application device for applying an adhesive, and wherein the pushing-in element is arranged in the drum for transferring the pocket spring strings to which an adhesive has been applied into the assembly device.

3. A device for the assembly of pocket spring strings to form a spring core for mattresses, comprising:

receptacles for pocket spring strings formed of pocket springs, a transfer mechanism for transferring individually fed pocket spring strings from an insertion position (a) to a transfer position (c), and a pushing-in element for transferring the pocket spring strings from the transfer mechanism to an assembly device, wherein the transfer mechanism comprises a rotatably mounted drum, at the periphery of which are formed groove-shaped receptacles into which the pocket spring strings can be inserted and transferred from the insertion position (a) to an adhesive-bonding station (b), above which is arranged an application device for applying an adhesive, and wherein there are arranged in front of the drum two conveyor belts which are drivable so as to rotate parallel to the axis of rotation of the drum and the mutually facing strands of which are located at a spacing from one another which is less than the height of the pocket spring strings.

4. The device of claim 3, wherein the mutually facing strands are arranged so as to run conically towards one another in the entry region.

5. The device of claim 3, wherein an advancing element for transferring the pocket spring strings into the receptacles is arranged in front of the conveyor belts.

6. A device for the assembly of pocket spring strings to form a spring core for mattresses, comprising:

receptacles for pocket spring strings formed of pocket springs, a transfer mechanism for transferring individually fed pocket spring strings from an insertion position (a) to a transfer position (c), and a pushing-in element for transferring the pocket spring strings from the transfer mechanism to an assembly device, wherein the transfer mechanism comprises a rotatably mounted drum, at the periphery of which are formed groove-shaped receptacles into which the pocket spring strings can be inserted and transferred from the insertion position (a) to an adhesive-bonding station (b), above which is arranged an application device for applying an adhesive, and wherein webs are arranged at regular spacings on the periphery of the drum and hold the springs in the spring strings in a precise position on the drum.

7. The device of claim 6, wherein the webs are mounted so as to be axially displaceable to the respective diameter of the springs in the spring strings.

8. The device of claim 6, wherein the webs are fastened to strips which lie parallel to the shaft and by which the webs are displaceable axially by half a spacing between respectively two springs in the pocket spring string.

9. The device of claim 8, wherein the axial displacement of the webs is effected manually or via a drive.

10. A device for the assembly of pocket spring strings to form a spring core for mattresses, comprising:

receptacles for pocket spring strings formed of pocket springs, a transfer mechanism for transferring individually fed pocket spring strings from an insertion position (a) to a transfer position (c), and a pushing-in element for transferring the pocket spring strings from the transfer mechanism to an assembly device, wherein the transfer mechanism comprises a rotatably mounted drum, at the periphery of which are formed groove-shaped receptacles into which the pocket spring strings can be inserted and transferred from the insertion position (a) to an adhesive bonding station (b), above which is arranged an application device for applying an adhesive, wherein the pushing-in element expels the pocket spring string from the receptacle located at the transfer position (c) while the drum remains stationary.

* * * * *